US005205334A

United States Patent [19]

Judkins

[11] Patent Number: 5,205,334

[45] Date of Patent: Apr. 27, 1993

[54] DOUBLE LAYER SHADE

[75] Inventor: Ren Judkins, Killbuck Township, Allegheny County, Pa.

[73] Assignee: Verosol USA Inc., Pittsburgh, Pa.

[21] Appl. No.: 771,148

[22] Filed: Oct. 3, 1991

[51] Int. Cl.[5] ..... E06B 9/40

[52] U.S. Cl. ..... 160/89; 160/84.1; 160/108

[58] Field of Search ..... 160/84.1, 87, 89, 108, 160/109, 110, 111, 112, 127, 242, 32, 115, 35

[56] References Cited

U.S. PATENT DOCUMENTS

| | | | |
|---|---|---|---|
| 553,143 | 1/1896 | Watts | 160/112 X |
| 792,548 | 6/1905 | Oliver | 160/112 |
| 927,090 | 7/1909 | Anderson | 160/110 |
| 1,601,665 | 9/1926 | Alphin | 160/112 |
| 1,636,601 | 7/1927 | Givens | 160/108 X |
| 1,731,124 | 10/1929 | Carper | 160/108 X |
| 2,175,761 | 10/1939 | Quinlan | 160/108 X |
| 2,201,356 | 5/1940 | Terrell | 156/16 |
| 2,350,094 | 5/1944 | Butts | 160/84 |
| 4,069,857 | 1/1978 | Brookshire | 160/84.1 |
| 4,347,885 | 9/1982 | Knorring et al. | 160/242 |
| 4,647,488 | 3/1987 | Schnebly et al. | 160/84.1 X |
| 4,953,610 | 9/1990 | Phillips et al. | 160/84.1 |
| 4,974,656 | 12/1990 | Judkins | 160/84.1 |

FOREIGN PATENT DOCUMENTS 0058459 8/1982 European Pat. Off. .

*Primary Examiner*—David M. Purol
*Attorney, Agent, or Firm*—Buchanan Ingersoll

[57] ABSTRACT

A roller shade is mounted within a headrail and a pleated shade is attached to the bottom of the headrail to form a double layer shade. The two shades are independently operable. When both shades are extended the double layer shade provides a thermally efficient window covering.

27 Claims, 8 Drawing Sheets

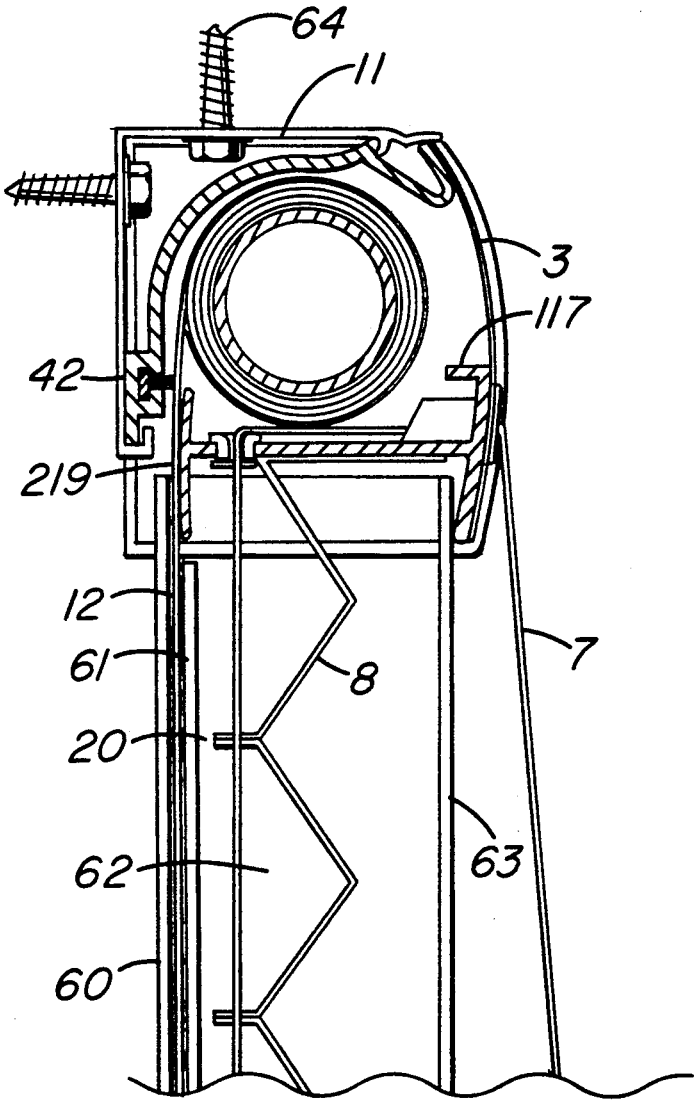
FIG. 9
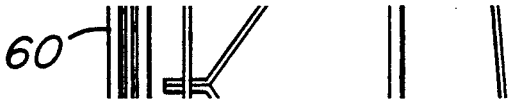

DOUBLE LAYER SHADE

FIELD OF THE INVENTION

The present invention relates to window shades and particularly a double window shade construction having two independently operable shades in a front to back relationship.

BACKGROUND OF THE INVENTION

Numerous window shades are presently available. Roller shades usually utilize a spring loaded roller which is mounted at the top of a window frame adjacent the window. A panel of material is wound onto the roller which can be unrolled to cover the window. Insulated shades that are quilted with spun batting or foam are more effective for saving energy, but they are bulky and they tend to wrinkle when they roll because the side nearest the roller must accommodate a smaller diameter than the opposite side. Round floating bottom rails have also been used with multiple layer shades with some success. Overall these shades are limited by the selection of fabrics that won't wrinkle and the cost of inventorying relatively expensive sandwiches. Another problem with insulating shades is their flat look that is not considered as aesthetically pleasing as a full undulating multi-faceted look provided by drapes and pleated shades. Finally, multi-layer or insulated shades are generally opaque or nearly so because of their multiple layer nature. Consequently, they are even more limited in the range of light control than most regular non louvered window coverings.

Another type of shade utilizes a pleated panel of material which stacks by folding in an accordion fashion. There may be a single layer of zigzag fabric or a zigzag layer with a tab extending off one side of each pleat. The top of the material is attached to a headrail mounted adjacent the window. A bottom rail is provided at the bottom of the material. A cord extends from the top rail through the material to the bottom rail for raising and lowering the pleated shade and for supporting the weight of the bottom rail which allows the fabric to maintain a fullness or three-dimensional character and to refold consistently when stacked. This type of shade is available in a variety of fabrics ranging from translucent to opaque. Because of their resilient nature, pleated shades are difficult to insulate, instead the art has developed honeycomb structures using two or three panels of pleated material. Although these panels can be made of different materials they are rigidly affixed to one another and cannot be moved relative to one another and are, therefore, limited in light control. Although the cells effectively reduce thermal convection, the connections between layers act as bridges for thermal conduction and are inviting burrows for insects. When condensation does occur, the moisture is trapped within the cell and often stains the fabric.

In U.S. Pat. No. 4,953,610 Phillips et al. disclose a double window shade assembly having two independently operable pleated shades located in a front to back relationship. They prefer the front shade to be made of substantially translucent or light passing material while the back shade is made of substantially opaque or light blocking material. The user of the window shade assembly is able to adjust one or both of the front and back shades to control where outside light is able to pass through the assembly. Sunlight may be blocked by the rear shade, pass through the front shade or pass directly into the room without obstruction from either shade. Because there are two adjacent pleated shades, the product is nearly twice as wide as single panel shade. Accordingly, this shade is not suitable for narrow window frames. The system of the '610 patent also includes a single head rail and a primary bottom rail. One cord passes from the head rail through the front shade to the primary bottom rail. A second cord passes from the headrail through the rear shade to the primary bottom rail. These two cords maintain the front shade a fixed distance from the rear shade. Because of this arrangement it is not possible to lower the rear shade without also lowering the front shade. The side edges of pleated-type shades have a zigzag three-dimensional character and are relatively delicate which makes them hard to positively seal for an air-tight energy-effective fit.

The art has recognized that convection currents will develop between window panes, between a window pane and a shade or between two window shade panels whenever the distance between them exceeds approximately 0.5". The currents transport heat across air spaces via gravitationally driven circulation reducing the thermal efficiency of the system. Such currents can be significantly reduced by closing at least portions of the gap between the two panels to a distance less than 0.5".

Roller shades are difficult to install when compared to a pleated shade because they are only supported at the ends and they must be hung plumb or be adjusted with shims in the roll of the fabric so that they roll evenly on the roller. It is common practice to leave a considerable clearance between the end brackets and the fabric to avoid abrading the edge of the fabric on the brackets. It is important to be able to inspect the roller as the shade is being operated, and to be able to shim the diameter of the tube or to adjust the relative position of at least one end bracket. It is an object of this invention to be able to install a single set of mounting brackets that can be mounted anywhere along the length of the headrail as is the common practice in pleated shades and which support the headrail of the pleated shade and the end brackets of the roller shade.

Although double panel window shades have been proposed, the art has not found a shade which combines both a pleated shade and roller shade in a compact, thermally efficient manner and in which the roller shade and pleated shade are truly independently operable and easily installed.

SUMMARY OF THE INVENTION

I provide a double layer shade comprised of a roller shade and a pleated shade arranged in front to back relationship. The pleated shade is attached to the bottom of a headrail. The roller shade is preferably mounted above, but possibly adjacent to, the pleated shade. I prefer to position the roller shade and pleated shade so that the gap between them will be such as to impede thermal convention currents when both are in an extended position and mimic the thermal and visual quantities of honeycombs while eliminating thermal bridges, water traps, insect homes, and the limited light control. This configuration also has all the advantages of roller shades including the ability to be made from low cost films and laminates and to readily seal along its side edges. I also provide an integrated compact hardware system that allows either shade layer to be operated from the room side without disturbing the other layer; that can be installed with one set of easily mounted brackets that can be placed anywhere along the length of the headrail or at the ends; and that minimizes the space required to store the two layers when they are raised off the window opening by utilizing the corners of space around the roller. The roller shade and the pleated shade are independently operable to enable a full range of light control and aesthetic alternatives. In this structure one can have both the roller shade and the pleated shade down or have only the roller shade down or have only the pleated shade down or have either of them in any combination of intermediate positions. To achieve the desired degree of privacy the roller shade is preferably made of a substantially opaque or light blocking material whereas the pleated shade is made of a translucent or sheer material.

I prefer to utilize a pleated shade of the type having tabs extending from the rear pleats as is disclosed in my U.S. Pat. No. 4,974,656.

Additional advantages of the present invention will become readily apparent from the following discussion particularly in taken in conjunction with the accompanying drawings.

BRIEF DESCRIPTION OF THE DRAWINGS

FIG. 9 is a side view showing another optional configuration for the embodiment of FIG. 3.

DESCRIPTION OF THE PREFERRED EMBODIMENTS

Figure 2:
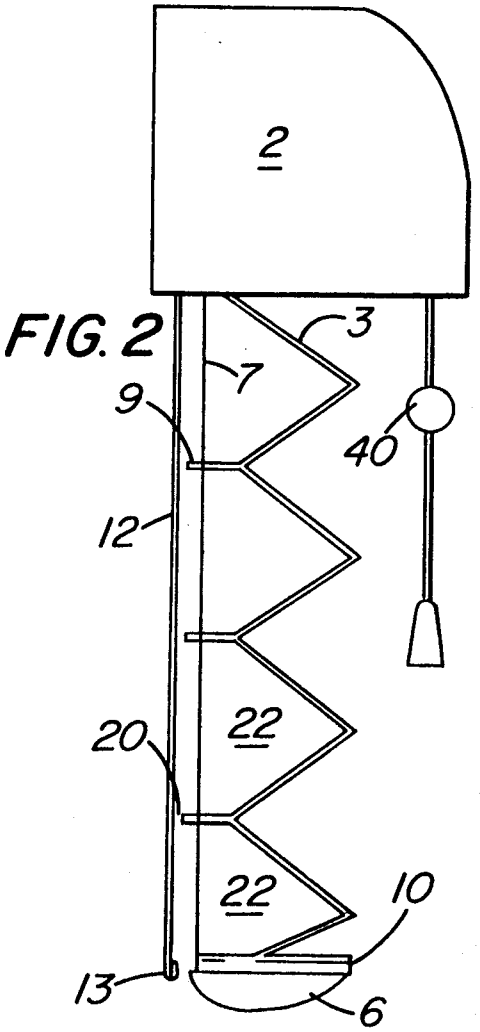
FIG. 2 is a side view of the window shade assembly of FIG. 1.
Figure 1:
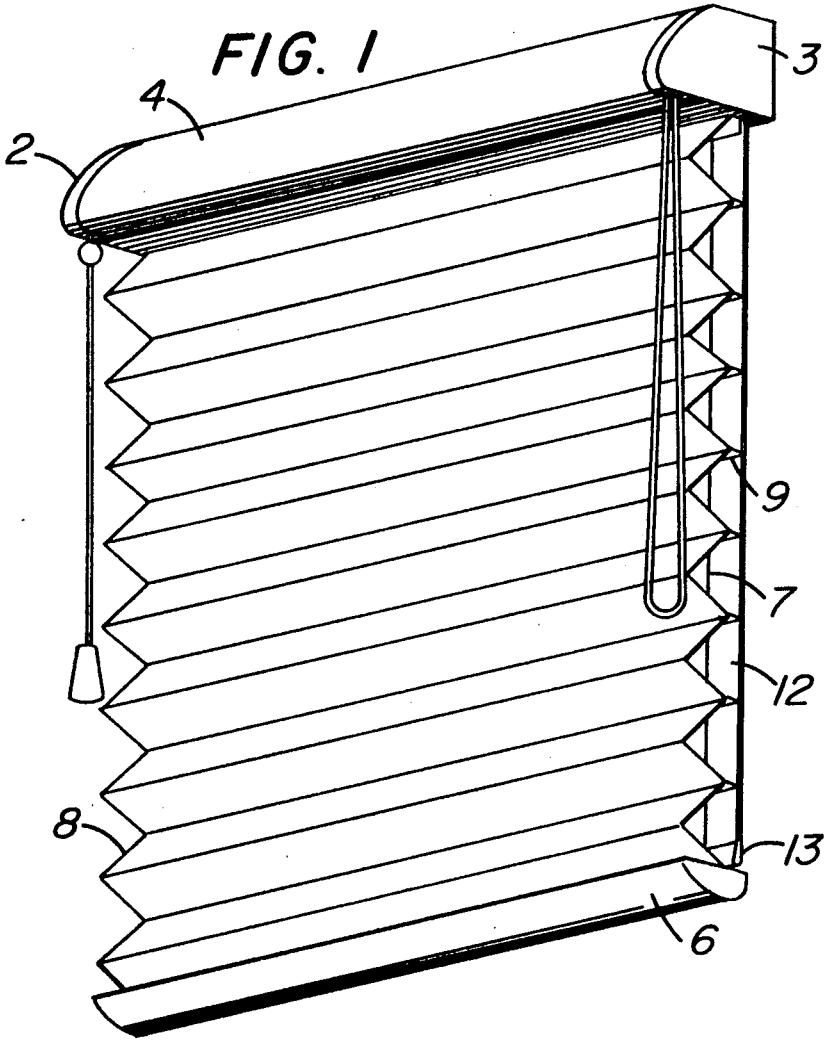
FIG. 1 is a perspective view of a window shade assembly of the present invention.
Figure 3:
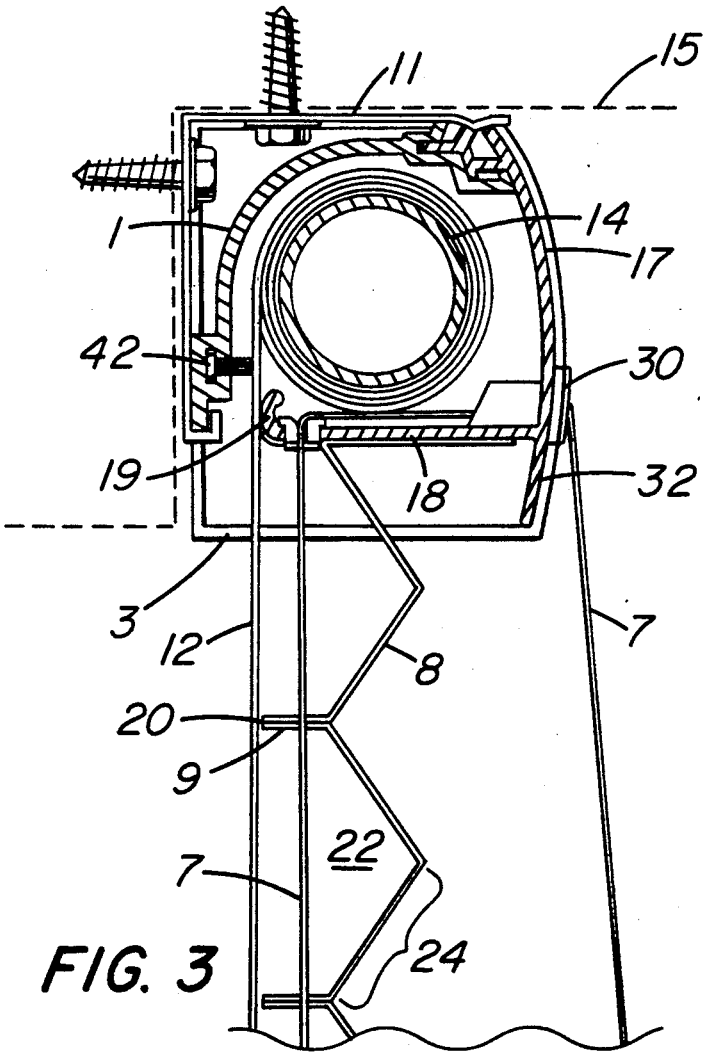
FIG. 3 is an end view of a headrail similar to the headrail of the embodiment of FIG. 1 with the end cap removed showing a present preferred headrail interior configuration.

As shown in FIGS. 1 and 2, I provide a headrail 1 which supports both the pleated shade 8 and a roller shade 12. End caps 2 and 3 are provided at either end of the headrail and a roller shade mechanism is mounted within the headrail. The headrail is attached to a wall or window frame 15 shown in chainline in FIG. 3. A wall mount may be made through bracket 11 or end caps 2 or 3. A ceiling or wall mount is made through bracket 11. The roller shade 12 is wound around roller 14 which rides on brackets that are preferably built into the end caps 2 and 3. The pleated shade 8 is mounted to the bottom 18 of the pleated subrail 17. If desired, the front face 4 of the headrail can be extended by leg 32 as shown in FIG. 3 to obscure all or a portion of fabric stack. I prefer to provide tabs 9 which extend from the rear pleats of fabric 8. Cord 7 passes through holes in the tabs 9 to bottom rail 6 for the pleated shade. The opposite end of cord 7 extends through the end cap 2 or cord back as shown in FIG. 1. This cord is used to raise and lower the pleated shade.

Roller shades are one of the least expensive methods for covering a window. The fabric is minimal and the hardware and fabrication are simple and well established. However, the appearance for, at least, the inexpensive roller shade is very plain. I expect, therefore, that the roller shade layer will usually be on the window side with an opaque or semi-opaque material that will afford privacy when lowered along with the pleated front shade. The material may also be impervious to water vapor to act as a vapor barrier, aluminized to act as a heat mirror and water-proof to be easily washed. Again, these characteristics are more efficiently achieved with a roller shade than any other system because of its flat nature.

In the embodiments of FIGS. 1, 2, 3, 4, 8, 9 and 10, the extended roller shade 12 is positioned behind the pleated material 8. I prefer to provide a shade guide 19, 119 or 219 within the headrail. This will assure that shade 12 when extended will be parallel to pleated shade 8. Guide 19, 119 or 219 and the pleated fabric are positioned so as to keep tabs 9 of the pleated shade 8 very close to roller shade 12. I prefer that gap 20 between roller shade 12 and tabs 9 not extend more than ½". When the tab 9 is that close to roller shade 12 air flow between cells 22 will be greatly restricted. Accordingly, convection currents will not develop between roller shade 12 and pleated shade 8. Since cords 7 passes through cord holes (not shown) in tabs 9 rather than the center of the sections in material 8, the cords are not visible from the front of the shade providing a pleasing visual appearance. The absence of holes in the sections of material 24 also prevents light and air from passing through such holes and therefore enhances the insulating effect of the shade. This effect may be further enhanced by having a metalized rear layer or coating on pleated shade 8 or roller shade 12 or both.

I prefer to use a sheer or translucent material for the front layer which is pleated shade 8 in the embodiment of FIG. 1 so that light may pass through the window and the pleated shade 8 into the room. Preferably the openness factor will be small enough to prevent glare and fading. I further prefer to make roller shade 12 from opaque or nearly opaque material so as to prevent light from passing through it. Thus, one could obtain privacy by pulling down roller shade 12. The front layer of any shade is always decorative and generally the more expensive layer. In the embodiment of FIG. 1, the front layer is the pleated shade. Generally, the front layer is lowered to prevent glare and the back layer is lowered only for room darkening or privacy. Both shades can be raised for a clear view or for cleaning the windows.

Figure 6:
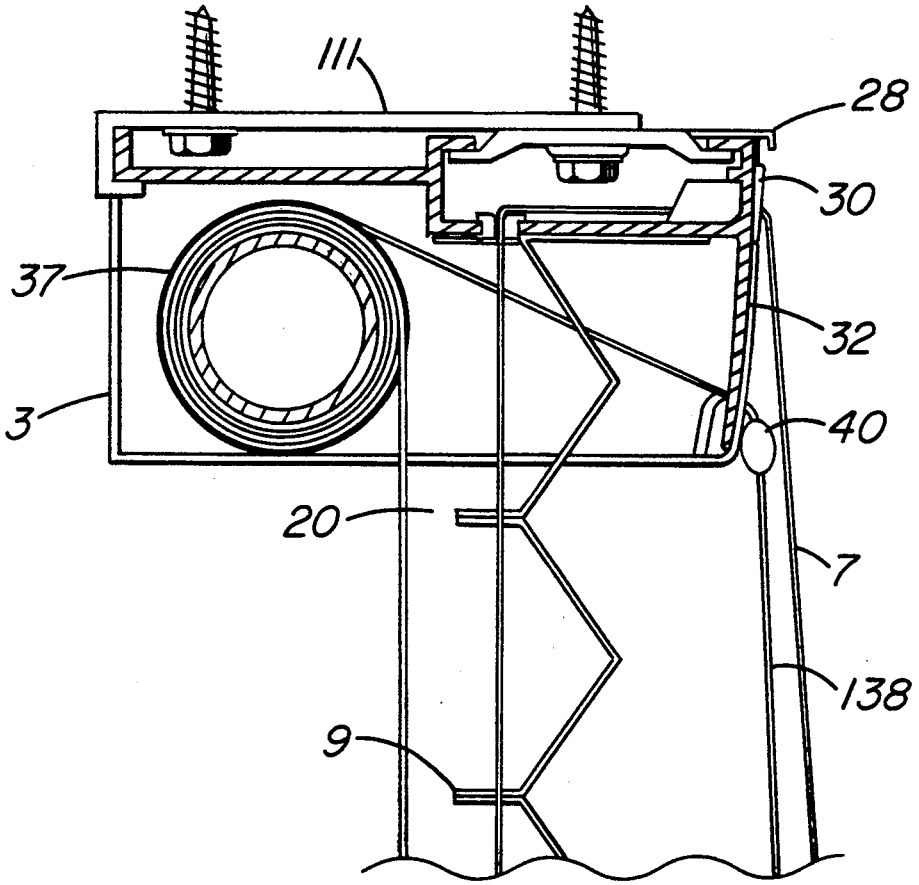
FIG. 6 is a view of a third preferred headrail for the window shade assembly of the present invention.
Figure 7:
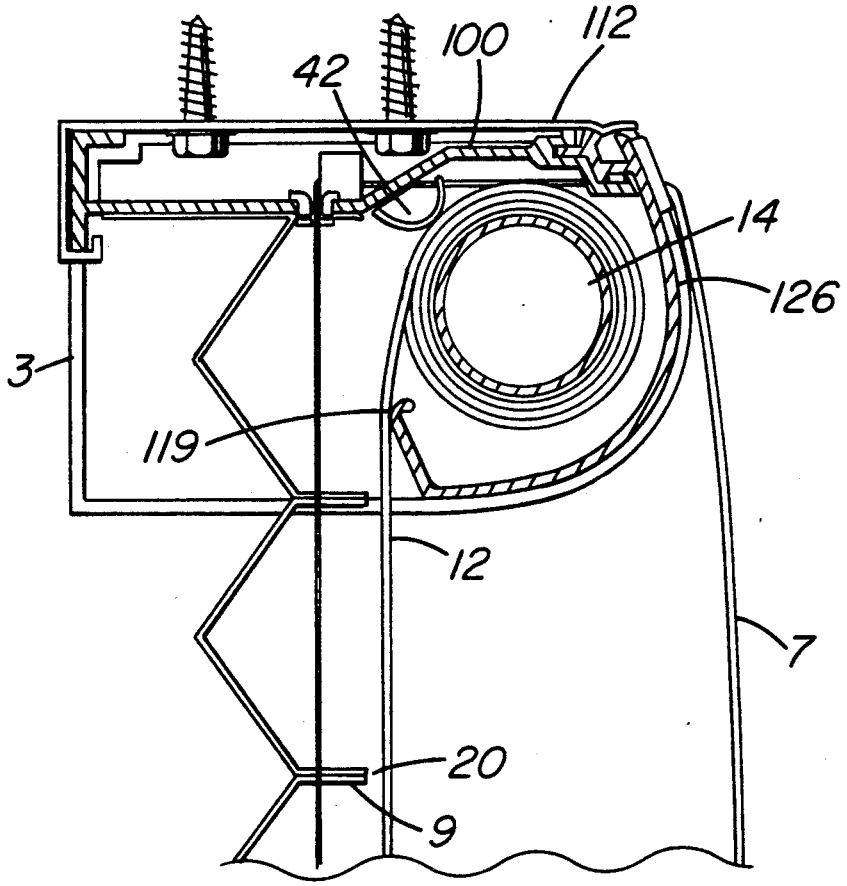
FIG. 7 is an end view of a third preferred headrail assembly for the widow shade of the present invention.

The configuration shown in FIGS. 1, 2, 3, 5, 8, 9 and 10 provide a narrow headrail suitable for most windows. One could also place the shade roller 14 adjacent the pleated shade as shown in FIGS. 6 and 7. In these embodiments where like numbered parts are similarly numbered, the headrail is shorter, but has a greater depth than the headrail of FIGS. 2 and 3. In the embodiment of FIG. 6, I prefer to have the roller adjustable in both vertical and horizontal directions which allows adjustment for larger rolls of fabric required for longer windows or thicker fabric types. For these applications the embodiments shown in FIGS. 6 and 7 would generally better fit into the available space.

Figure 4:
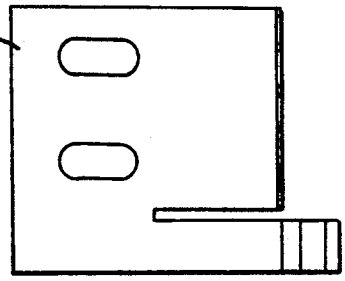
FIG. 4 is a top view of the bracket shown in FIG. 3.

FIG. 4 shows a top view of the bracket shown in FIG. 3 and is typical of the style used in most of the embodiments. It consists of individual brackets that can be mounted separately anywhere along the width of the window and then the headrail can be snapped into or out of the brackets easily. Any of the embodiments could also be supported by end mounted brackets particularly the embodiment shown in FIG. 9 which has a subrail for the pleated shade that is supported only at the ends. The pleated shade can be fabricated separately. Before he puts on the valance, the installer can see the shade from the front for more intuitive adjustments.

Figure 5:
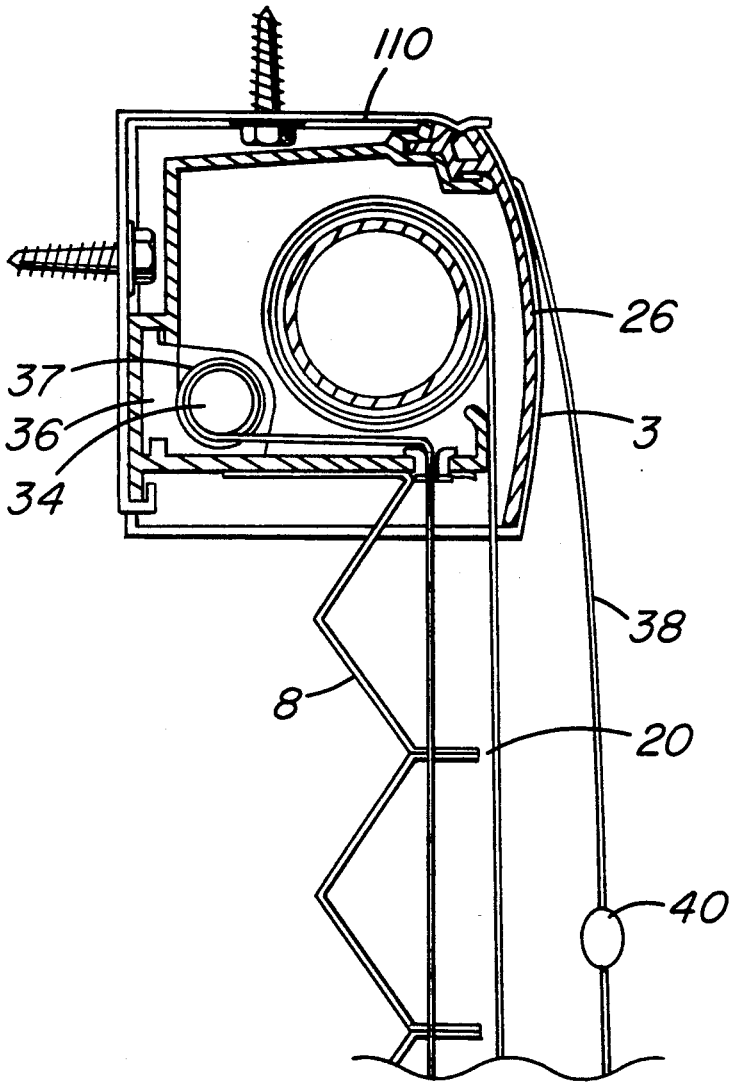
FIG. 5 is an end view of a second preferred configuration of a headrail for the window shade assembly of the present invention.

FIG. 5 shows an embodiment that has the roller shade in the front and the pleated shade hung underneath the roller. A valance is snapped over the front which is open for fabrication and easier installation. The cords 7 are wound around a tube 34 supported by blocks 36 with a capstan 37 at the one end that turns the tube when the strap 38 is pulled and unwinds off of the capstan which raises the shade. The shade 8 is held in any raised position by locking the strap 38, the capstan 37, or the tube 34. To reverse the process and lower the shade, gravity is allowed to unwind the lift cords 7 and turn the tube 34 which winds the strap 38 back onto the capstan 37. A stop lead 40 clamped onto the strap 38 sets the length of the pleated shade 8.

Figure 10:
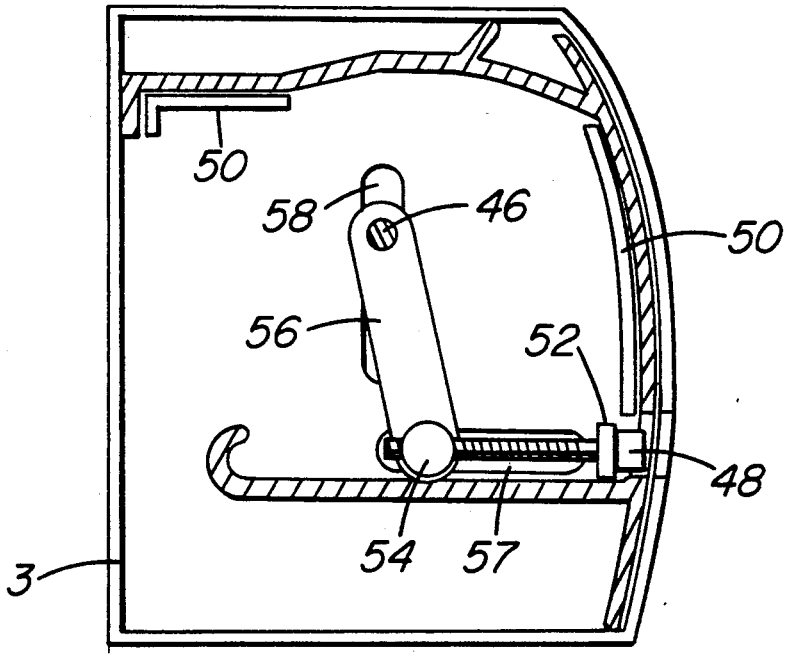
FIG. 10 is a side view partially in section showing a means for adjusting the roller in the preferred embodiments.

As shown in the embodiment of FIG. 5 which uses a deeper bracket 110, one could reverse the orientation of the device so that the roller shade 12 when viewed from the room appears in front of the pleated shade 8. To achieve the thermal benefits previously described, I prefer that tabs 9 be facing inwardly toward shade 12. It is advisable to have a means for adjusting the roller position relative to the wall or ceiling as shown in FIG. 10.

The embodiment of FIG. 6 uses yet another bracket 111 and also includes a strap 138 for rolling up the window shade. One raises the roller shade by pulling downward on the cord and then locking the cord to a cleat or a cord lock to hold any position. The cord 27 is simply released to allow gravity to pull the shade down and spool the cord on the mandril 29 for another cycle. Stop 40 sets the length of the drop. To roll up the shade one then simply pulls on cord 27. A wing type bracket 28 is also shown. This type of bracket is frequently used in window curtains and is readily available.

FIG. 7 reverses the orientation of the embodiment in FIG. 6. The valance 126 also incorporates a shade guide 119 for maintaining the proximity of the two shade layers and for sealing the top edge of the roller shade 12 when side seals are used. A second weather seal 42 can also be used to seal the top perimeter of the shade 12. The seal 42 extends from valance support 100 attached to mounting bracket 112.

Figure 8:
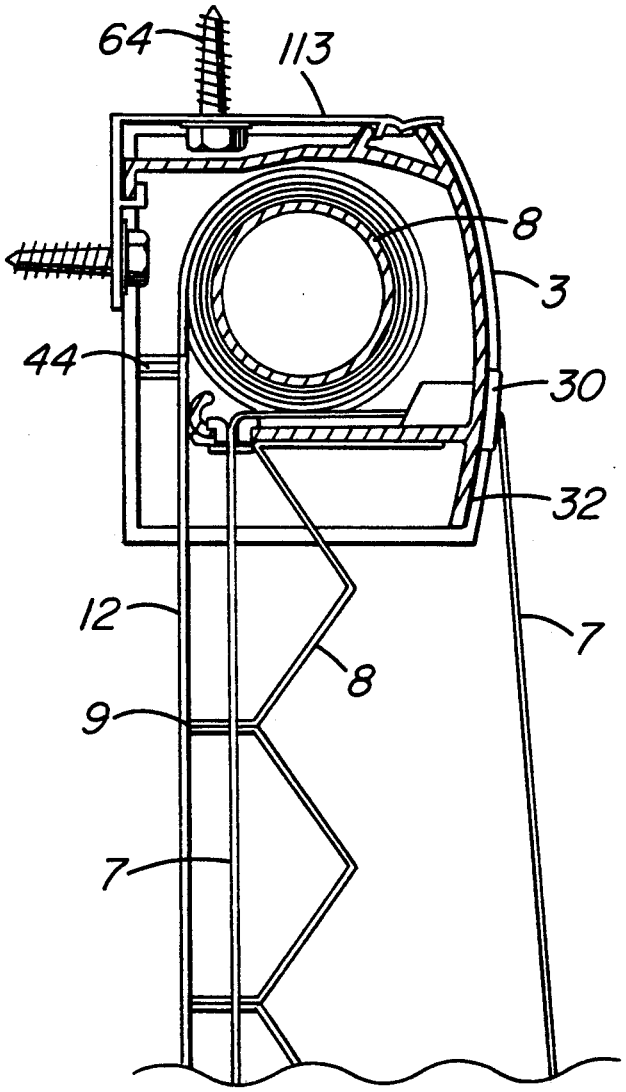
FIGS. 8 is a side view showing an optional configuration of the preferred embodiment of FIG. 3.

FIG. 8 shows an embodiment similar to the one shown in FIG. 3 except that it has a one piece headrail. This embodiment can be top or side mounted using screws 64 which pass through bracket 113. This is easier to fabricate, but more difficult to adjust the shade during installation. It might be necessary to use screamers 44 which might be little straps of plastic film which vibrate and make a sound (scream) when the edge of the roller shade 8 moves across them. This would signal the installer to adjust the screw shown in FIG. 10 which in turn raises or lowers the pins 46 that support the shade roller. This adjustment is needed to accommodate windows that are not plumb. Adjustments for roller diameter and fabric thickness should be made at the time of fabrication inspection by inserting shims in the fabric roll. Each end cap 2 and 3 would have an opening in the front face for access to the adjustment screw 48 which is held by a retainer 52 that is fixed to the end cap 3 and allows the screw to turn freely but not translate. The screw then passes through a theaded pin 54 which passes through the lever 56 and also is guided by the horizontal slot 57. When the screw 48 is turned the threaded pin 54 moves to and fro in the horizontal slot which causes the lever to move the roller pin 46 up or down in the vertical slot 58 adjusting the roller relative to the end cap and thus the window frame. Walls 50 are shown for holding end cap 3 to headrail 1.

FIG. 9 shows an embodiment similar to those in FIGS. 3, 5 and 8 except that the subrail 117 for the pleated shade is only supported by the end caps 2 and 3. The shade guide 219 is larger to strengthen this subrail and also guides the shade 12 between the back leg and the middle leg 61 of the side seal track 62. The side seal can substantially reduce air and light leakage around the edge of the shade. It also helps the shade to roll up accurately by guiding the shade bottom rail 13 shown in FIG. 1. The front leg 63 is optional and hides the edge of the pleated shade 8, reduces light leakage and aids privacy when the roller shade 12 is raised. A brush type weather seal 42 is also shown. Although two screws 64 are shown this is only to illustrate that either one could be used or both.

Although I have shown certain present preferred embodiments of my double layer shade, it should be distinctly understood that the invention is not limited thereby, but may be variously embodied within the scope of the following claims.

I claim:

1. An energy efficient double layer shade having two independently movable layers comprising a) a headrail having a bottom and an interior sized to receive a roller shade, b) a panel of pleated material attached to the bottom of the headrail thereby permitting the pleated material to be folded and unfolded; and c) a roller shade of the type having a roller and a rolled panel of shade material positioned within the headrail thereby permitting the panel of shade material to be unrolled to a position substantially parallel to the pleated material when the pleated material is unfolded wherein the unfolded pleated material and unrolled shade material are sufficiently close to one another so that convection currents will not develop therebetween.

2. The double layer shade of claim 1 wherein the panel of pleated material has a plurality of sections of pleated material, each of two adjacent sections meeting at a pleat preformed therein, alternate pleats projecting towards a front and back of the panel, and having a tab, along substantially the entire width of the material to from a tab projecting from the rear of each back projecting pleat, each tab having a cord hole therein, and also comprising a cord passing through a cord hole in each tab, the cord attached to the headrail and to the panel of pleated material at its bottom.

3. The double layer shade of claim 2 wherein the roller shade and the panel of pleated material are positioned to be substantially parallel when both are in an extended position and the tabs of the panel of pleated material are separated from the first panel by a distance of not more than about one-half inch.

4. The double layer shade of claim 1 wherein the headrail is adapted to be ceiling mounted.

5. The double layer shade of claim 1 wherein the headrail is adapted to be wall mounted.

6. The double layer shade of claim 1 wherein the headrail is adapted to be end mounted.

7. The double layer shade of claim 1 wherein the roller is mounted above the panel of pleated material.

8. The double layer shade of claim 7 wherein the shade material extends behind the panel of pleated material.

9. The double layer shade of claim 7 wherein the shade material extends in front of the panel of pleated material.

10. The double layer shade of claim 1 wherein the roller is positioned behind the panel of pleated material.

11. The double layer shade of claim 1 wherein the roller is mounted in front of the panel of pleated material.

12. The double layer shade of claim 1 wherein the roller is attached to the headrail thereby permitting adjustment of the roller relative to the headrail.

13. The double layer shade of claim 1 also comprising an adjustable bracket attached between the headrail and the roller to permit adjustment of the roller relative to the headrail to permit movement of one end of the roller along a vertical plane.

14. The double layer shade of claim 1 wherein the shade material is substantially comprised of a light-blocking material and the pleated material is substantially comprised of light-passing material.

15. The double layer shade of claim 14, wherein said light-blocking material prevents the passage of at least about 50% of the light thereon.

16. The double layer shade of claim 1 also comprising a roller cord attached to the roller.

17. The double layer shade of claim 16 also comprising a stop bead attached to the roller cord.

18. The double layer shade of claim 1 also comprising a pleated shade cord connected to the pleated material for unfolding and folding the pleated material, the cord also passing through the headrail.

19. The double layer shade of claim 18 also comprising cord collecting means within the headrail for collecting and releasing at least a portion of the pleated shade cord.

20. The double layer shade of claim 19 wherein the cord collecting means is a roller.

21. The double layer shade of claim 1 also comprising a guide attached to the bottom of the headrail which guide is sized and positioned to maintain the shade material at a selected distance from the pleated material.

22. The double layer shade of claim 21 wherein the guide is adjustable relative to the bottom.

23. The double layer shade of claim 1 wherein the headrail has a front face sized and configured so that when both the shade material and the pleated material are in a retracted position both materials will be entirely behind the front face.

24. The double layer shade of claim 1 also comprising a bottom rail attached to the bottom of the pleated material.

25. The double layer shade of claim 1 wherein the panel of pleated material is mounted to the headrail below the roller shade.

26. The double layer shade of claim 1 also comprising a roller cord attached to the roller shade and a pleated shade cord attached to the panel of pleated material wherein both the roller cord and the pleated shade cord pass through a front of the headrail.

27. The double layer shade of claim 26 wherein the roller shade is comprised of a shade material on a capstan and the roller shade cord is attached to the capstan.

* * * * *

UNITED STATES PATENT AND TRADEMARK OFFICE

CERTIFICATE OF CORRECTION

PATENT NO. : 5,205,334

DATED : April 27, 1993

INVENTOR(S) : REN JUDKINS

It is certified that error appears in the above-identified patent and that said Letters Patent is hereby corrected as shown below:

Column 6, line 58, claim 2, change "from" to --form--.

Column 6, line 68, claim 3, change "first panel" to --unrolled shade panel--.

Signed and Sealed this

Fifteenth Day of February, 1994

*Attest:*

*Attesting Officer*

BRUCE LEHMAN

*Commissioner of Patents and Trademarks*